US007626347B2

(12) United States Patent
Sliski et al.

(10) Patent No.: US 7,626,347 B2
(45) Date of Patent: Dec. 1, 2009

(54) PROGRAMMABLE RADIO FREQUENCY WAVEFORM GENERATOR FOR A SYNCHROCYCLOTRON

(75) Inventors: Alan Sliski, Lincoln, MA (US); Kenneth Gall, Harvard, MA (US)

(73) Assignee: Still River Systems, Inc., Littleton, MA (US)

( * ) Notice: Subject to any disclaimer, the term of this patent is extended or adjusted under 35 U.S.C. 154(b) by 0 days.

(21) Appl. No.: 12/011,466

(22) Filed: Jan. 25, 2008

(65) Prior Publication Data

US 2008/0218102 A1 Sep. 11, 2008

Related U.S. Application Data

(63) Continuation of application No. 11/371,622, filed on Mar. 9, 2006, now Pat. No. 7,402,963, which is a continuation of application No. 11/187,633, filed on Jul. 21, 2005, now abandoned.

(60) Provisional application No. 60/590,089, filed on Jul. 21, 2004.

(51) Int. Cl.
*H05H 13/00* (2006.01)

(52) U.S. Cl. ..... 315/502; 315/507; 250/396 R

(58) Field of Classification Search ..... 315/501–503, 315/507; 250/396 R, 423 R, 424; 313/62
See application file for complete search history.

(56) References Cited

U.S. PATENT DOCUMENTS 2,492,324 A * 12/1949 Salisbury ..... 315/502
2,615,129 A 10/1952 McMillan
2,701,304 A * 2/1955 Dickinson ..... 315/502
3,689,847 A 9/1972 Nico
4,047,068 A 9/1977 Ress et al.
4,139,777 A 2/1979 Rautenbach
4,345,210 A * 8/1982 Tran ..... 315/502
4,641,057 A 2/1987 Blosser et al.

(Continued)

OTHER PUBLICATIONS

Schneider, R., et al., "Nevis Synchrocyclotron Conversion Program—RF System," *IEEE Transactions on Nuclear Science USA ns16*(3) pp. 430-433 (Jun. 1969).

(Continued)

*Primary Examiner*—David Hung Vu
*Assistant Examiner*—Tung X Le
(74) *Attorney, Agent, or Firm*—Hamilton, Brook, Smith & Reynolds, P.C.

(57) ABSTRACT

A synchrocyclotron comprises a resonant circuit that includes electrodes having a gap therebetween across the magnetic field. An oscillating voltage input, having a variable amplitude and frequency determined by a programmable digital waveform generator generates an oscillating electric field across the gap. The synchrocyclotron can include a variable capacitor in circuit with the electrodes to vary the resonant frequency. The synchrocyclotron can further include an injection electrode and an extraction electrode having voltages controlled by the programmable digital waveform generator. The synchrocyclotron can further include a beam monitor. The synchrocyclotron can detect resonant conditions in the resonant circuit by measuring the voltage and or current in the resonant circuit, driven by the input voltage, and adjust the capacitance of the variable capacitor or the frequency of the input voltage to maintain the resonant conditions. The programmable waveform generator can adjust at least one of the oscillating voltage input, the voltage on the injection electrode and the voltage on the extraction electrode according to beam intensity and in response to changes in resonant conditions.

44 Claims, 10 Drawing Sheets

U.S. PATENT DOCUMENTS

| | | | | |
|---|---|---|---|---|
| 4,641,104 | A | 2/1987 | Blosser et al. | |
| 5,336,891 | A | 8/1994 | Crewe | |
| 5,726,448 | A | 3/1998 | Smith et al. | |
| 6,433,494 | B1 * | 8/2002 | Kulish et al. | 315/500 |
| 6,441,569 | B1 * | 8/2002 | Janzow | 315/502 |
| 6,683,426 | B1 | 1/2004 | Kleeven | |
| 2005/0247890 | A1 | 11/2005 | Norimine et al. | |

OTHER PUBLICATIONS

Enchevich, B., et al., "Minimizing Phase Losses in the 680 MeV Synchrocyclotron by Correcting the Accelerating Voltage Amplitude," *Atomnaya Energiya 26:*(3), pp. 315-316 (1969).

Allardyce, B.W., et al., "Performance & Prospects of the Reconstructed CERN 600 MeV Synchro-Cyclotron," *IEEE Transactions on Nuclear Science USA ns-24:*(3), pp. 1631-1633 (Jun. 1977).

Blosser, H.G., "Synchrocyclotron Improvement Programs," *IEEE Transactions on Nuclear Science USA ns16:*(3), pp. 59-65 (Jun. 1969).

Blosser, H.G., "Compact Superconducting Synchrocyclotron Systems for Proton Therapy," *Nuclear Instruments & Methods in Physics Research, B40-42*, pp. 1326-1330 (Apr. 1989).1

Lecroy, W., et al., "Viewing Probe for High Voltage Pulses," *Review of Scientific Instruments USA 31:*(12), p. 1354 (Dec. 1960).

* cited by examiner

PROGRAMMABLE RADIO FREQUENCY WAVEFORM GENERATOR FOR A SYNCHROCYCLOTRON

RELATED APPLICATIONS

This application is a continuation of U.S. application Ser. No. 11/371,622, filed Mar. 9, 2006, now U.S. Pat. No. 7,402,963, which is a continuation of U.S. application Ser. No. 11/187,633, filed Jul. 21, 2005, now abandoned, which claims the benefit of U.S. Provisional Application No. 60/590,089, filed on Jul. 21, 2004. The entire teachings of the above applications are incorporated herein by reference.

BACKGROUND OF THE INVENTION

In order to accelerate charged particles to high energies, many types of particle accelerators have been developed since the 1930s. One type of particle accelerator is a cyclotron. A cyclotron accelerates charged particles in an axial magnetic field by applying an alternating voltage to one or more "dees" in a vacuum chamber. The name "dee" is descriptive of the shape of the electrodes in early cyclotrons, although they may not resemble the letter D in some cyclotrons. The spiral path produced by the accelerating particles is normal to the magnetic field. As the particles spiral out, an accelerating electric field is applied at the gap between the dees. The radio frequency (RF) voltage creates an alternating electric field across the gap between the dees. The RF voltage, and thus the field, is synchronized to the orbital period of the charged particles in the magnetic field so that the particles are accelerated by the radio frequency waveform as they repeatedly cross the gap. The energy of the particles increases to an energy level far in excess of the peak voltage of the applied radio frequency (RF) voltage. As the charged particles accelerate, their masses grow due to relativistic effects. Consequently, the acceleration of the particles becomes non-uniform and the particles arrive at the gap asynchronously with the peaks of the applied voltage.

Two types of cyclotrons presently employed, an isochronous cyclotron and a synchrocyclotron, overcome the challenge of increase in relativistic mass of the accelerated particles in different ways. The isochronous cyclotron uses a constant frequency of the voltage with a magnetic field that increases with radius to maintain proper acceleration. The synchrocyclotron uses a decreasing magnetic field with increasing radius and varies the frequency of the accelerating voltage to match the mass increase caused by the relativistic velocity of the charged particles.

In a synchrocyclotron, discrete "bunches" of charged particles are accelerated to the final energy before the cycle is started again. In isochronous cyclotrons, the charged particles can be accelerated continuously, rather than in bunches, allowing higher beam power to be achieved.

In a synchrocyclotron, capable of accelerating a proton, for example, to the energy of 250 MeV, the final velocity of protons is 0.61 c, where c is the speed of light, and the increase in mass is 27% above rest mass. The frequency has to decrease by a corresponding amount, in addition to reducing the frequency to account for the radially decreasing magnetic field strength. The frequency's dependence on time will not be linear, and an optimum profile of the function that describes this dependence will depend on a large number of details.

SUMMARY OF THE INVENTION

Accurate and reproducible control of the frequency over the range required by a desired final energy that compensates for both relativistic mass increase and the dependency of magnetic field on the distance from the center of the dee has historically been a challenge. Additionally, the amplitude of the accelerating voltage may need to be varied over the accelerating cycle to maintain focusing and increase beam stability. Furthermore, the dees and other hardware comprising a cyclotron define a resonant circuit, where the dees may be considered the electrodes of a capacitor. This resonant circuit is described by Q-factor, which contributes to the profile of voltage across the gap.

A synchrocyclotron for accelerating charged particles, such as protons, can comprise a magnetic field generator and a resonant circuit that comprising electrodes, disposed between magnetic poles. A gap between the electrodes can be disposed across the magnetic field. An oscillating voltage input drives an oscillating electric field across the gap. The oscillating voltage input can be controlled to vary over the time of acceleration of the charged particles. Either or both the amplitude and the frequency of the oscillating voltage input can be varied. The oscillating voltage input can be generated by a programmable digital waveform generator.

The resonant circuit can further include a variable reactive element in circuit with the voltage input and electrodes to vary the resonant frequency of the resonant circuit. The variable reactive element may be a variable capacitance element such as a rotating condenser or a vibrating reed. By varying the reactance of such a reactive element and adjusting the resonant frequency of the resonant circuit, the resonant conditions can be maintained over the operating frequency range of the synchrocyclotron.

The synchrocyclotron can further include a voltage sensor for measuring the oscillating electric field across the gap. By measuring the oscillating electric field across the gap and comparing it to the oscillating voltage input, resonant conditions in the resonant circuit can be detected. The programmable waveform generator can be adjusting the voltage and frequency input to maintain the resonant conditions.

The synchrocyclotron can further include an injection electrode, disposed between the magnetic poles, under a voltage controlled by the programmable digital waveform generator. The injection electrode is used for injecting charged particles into the synchrocyclotron. The synchrocyclotron can further including an extraction electrode, disposed between the magnetic poles, under a voltage controlled by the programmable digital waveform generator. The extraction electrode is used to extract a particle beam from the synchrocyclotron.

The synchrocyclotron can further include a beam monitor for measuring particle beam properties. For example, the beam monitor can measure particle beam intensity, particle beam timing or spatial distribution of the particle beam. The programmable waveform generator can adjust at least one of the voltage input, the voltage on the injection electrode and the voltage on the extraction electrode to compensate for variations in the particle beam properties.

This invention is intended to address the generation of the proper variable frequency and amplitude modulated signals for efficient injection into, acceleration by, and extraction of charged particles from an accelerator.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

This invention relates to the devices and methods for generating the complex, precisely timed accelerating voltages across the "dee" gap in a synchrocyclotron. This invention comprises an apparatus and a method for driving the voltage across the "dee" gap by generating a specific waveform, where the amplitude, frequency and phase is controlled in such a manner as to create the most effective particle acceleration given the physical configuration of the individual accelerator, the magnetic field profile, and other variables that may or may not be known a priori. A synchrocyclotron needs a decreasing magnetic field in order to maintain focusing of the particles beam, thereby modifying the desired shape of the frequency sweep. There are predictable finite propagation delays of the applied electrical signal to the effective point on the dee where the accelerating particle bunch experiences the electric field that leads to continuous acceleration. The amplifier used to amplify the radio frequency (RF) signal that drives the voltage across the dee gap may also have a phase shift that varies with frequency. Some of the effects may not be known a priori, and may be only observed after integration of the entire synchrocyclotron. In addition, the timing of the particle injection and extraction on a nanosecond time scale can increase the extraction efficiency of the accelerator, thus reducing stray radiation due to particles lost in the accelerating and extraction phases of operation.

Figure 1A:
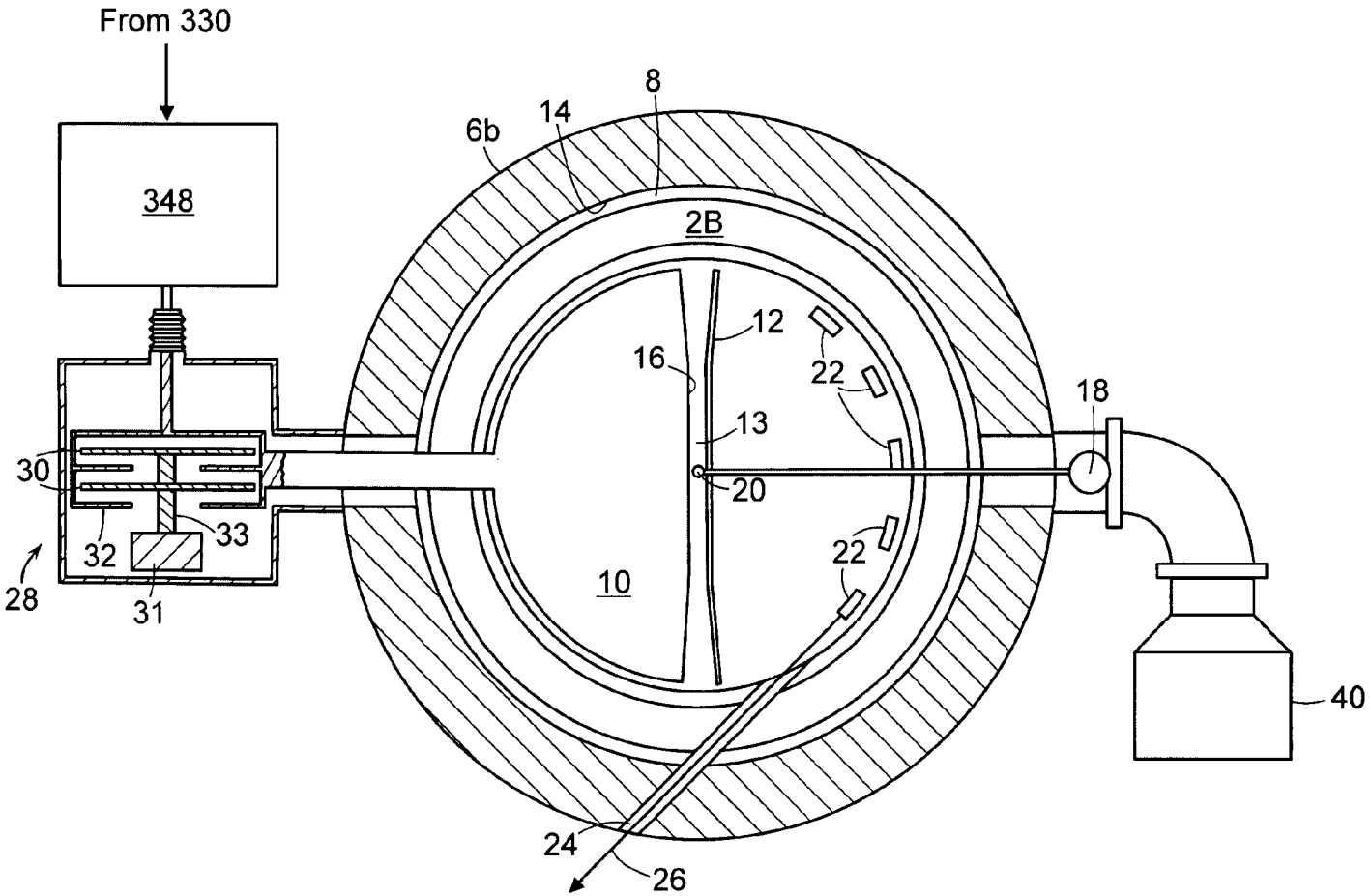
FIG. 1A is a plan cross-sectional view of a synchrocyclotron of the present invention.
Figure 1B:
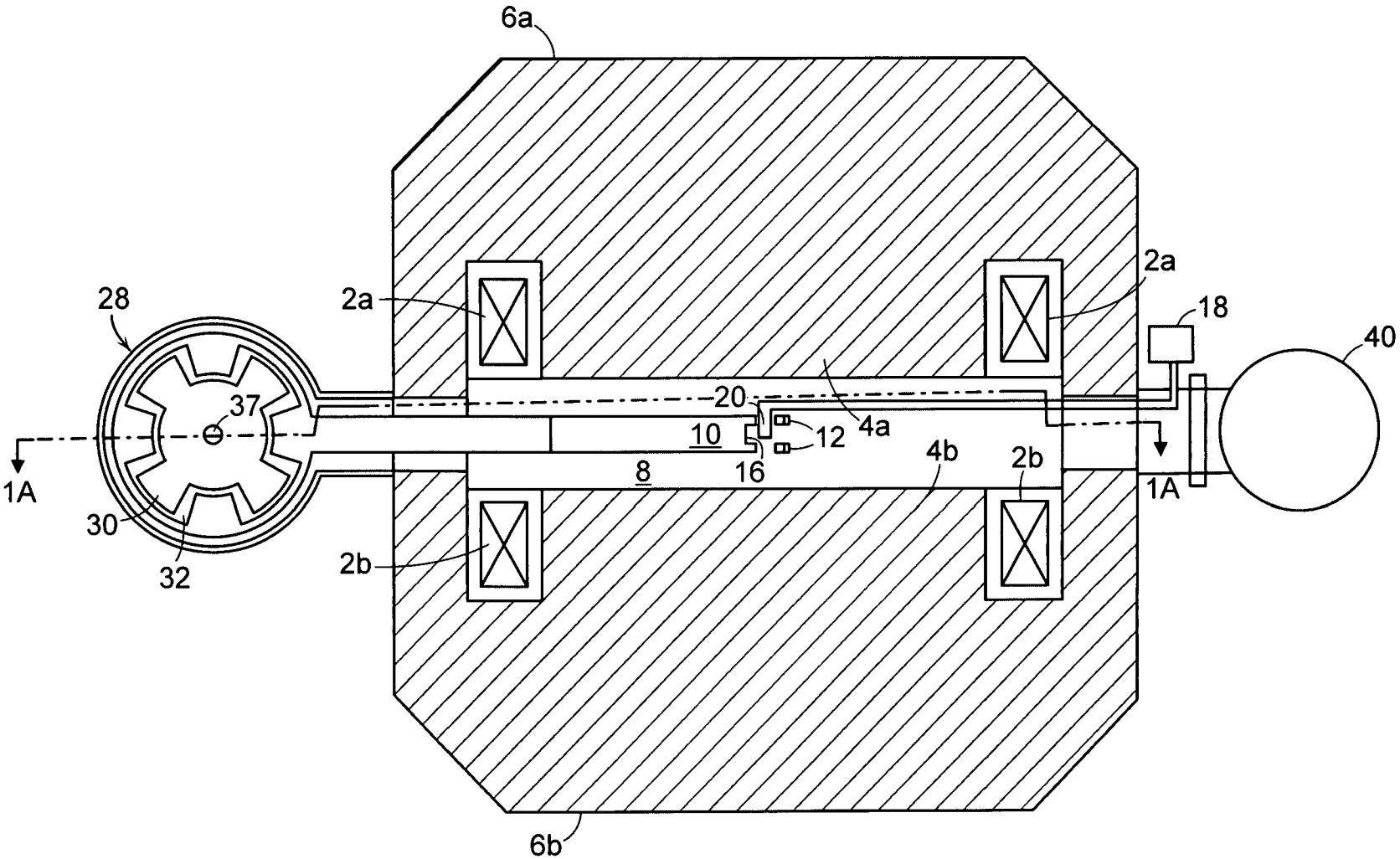
FIG. 1B is a side cross-sectional view of the synchrocyclotron shown in FIG. 1A.

Referring to FIGS. 1A and 1B, a synchrocyclotron of the present invention comprises electrical coils 2*a* and 2*b* around two spaced apart metal magnetic poles 4*a* and 4*b* configured to generate a magnetic field. Magnetic poles 4*a* and 4*b* are defined by two opposing portions of yoke 6*a* and 6*b* (shown in cross-section). The space between poles 4*a* and 4*b* defines vacuum chamber 8 or a separate vacuum chamber can be installed between the poles 4*a* and 4*b*. The magnetic field strength is generally a function of distance from the center of vacuum chamber 8 and is determined largely by the choice of geometry of coils 2*a* and 2*b* and shape and material of magnetic poles 4*a* and 4*b*.

The accelerating electrodes comprise "dee" 10 and "dee" 12, having gap 13 therebetween. Dee 10 is connected to an alternating voltage potential whose frequency is changed from high to low during the accelerating cycle in order to account for the increasing relativistic mass of a charged particle and radially decreasing magnetic field (measured from the center of vacuum chamber 8) produced by coils 2*a* and 2*b* and pole portions 4*a* and 4*b*. The characteristic profile of the alternating voltage in dees 10 and 12 is show in FIG. 2 and will be discussed in details below. Dee 10 is a half-cylinder structure, hollow inside. Dee 12, also referred to as the "dummy dee", does not need to be a hollow cylindrical structure as it is grounded at the vacuum chamber walls 14. Dee 12 as shown in FIGS. 1A and 1B comprises a strip of metal, e.g. copper, having a slot shaped to match a substantially similar slot in dee 10. Dee 12 can be shaped to form a mirror image of surface 16 of dee 10.

Ion source 18 that includes ion source electrode 20, located at the center of vacuum chamber 8, is provided for injecting charged particles. Extraction electrodes 22 are provided to direct the charge particles into extraction channel 24, thereby forming beam 26 of the charged particles. The ion source may also be mounted externally and inject the ions substantially axially into the acceleration region.

Dees 10 and 12 and other pieces of hardware that comprise a cyclotron, define a tunable resonant circuit under an oscillating voltage input that creates an oscillating electric field across gap 13. This resonant circuit can be tuned to keep the Q-factor high during the frequency sweep by using a tuning means.

As used herein, Q-factor is a measure of the "quality" of a resonant system in its response to frequencies close to the resonant frequency. Q-factor is defined as $$Q=1/R\times\sqrt{(L/C)},$$

where R is the active resistance of a resonant circuit, L is the inductance and C is the capacitance of this circuit.

Tuning means can be either a variable inductance coil or a variable capacitance. A variable capacitance device can be a vibrating reed or a rotating condenser. In the example shown in FIGS. 1A and 1B, the tuning means is rotating condenser 28. Rotating condenser 28 comprises rotating blades 30 driven by a motor 31. During each quarter cycle of motor 31, as blades 30 mesh with blades 32, the capacitance of the resonant circuit that includes "dees" 10 and 12 and rotating condenser 28 increases and the resonant frequency decreases. The process reverses as the blades unmesh. Thus, resonant frequency is changed by changing the capacitance of the resonant circuit. This serves the purpose of reducing by a large factor the power required to generate the high voltage applied to the "dees" and necessary to accelerate the beam. The shape of blades 30 and 32 can be machined so as to create the required dependence of resonant frequency on time.

The blade rotation can be synchronized with the RF frequency generation so that by varying the Q-factor of the RF cavity, the resonant frequency of the resonant circuit, defined by the cyclotron, is kept close to the frequency of the alternating voltage potential applied to "dees" 10 and 12.

The rotation of the blades can be controlled by the digital waveform generator, described below with reference to FIG. 3 and FIG. 4, in a manner that maintains the resonant frequency of the resonant circuit close to the current frequency generated by the digital waveform generator. Alternatively, the digital waveform generator can be controlled by means of an angular position sensor (not shown) on the rotating condenser shaft 33 to control the clock frequency of the waveform generator to maintain the optimum resonant condition. This method can be employed if the profile of the meshing blades of the rotating condenser is precisely related to the angular position of the shaft.

A sensor that detects the peak resonant condition (not shown) can also be employed to provide feedback to the clock of the digital waveform generator to maintain the highest match to the resonant frequency. The sensors for detecting resonant conditions can measure the oscillating voltage and current in the resonant circuit. In another example, the sensor can be a capacitance sensor. This method can accommodate small irregularities in the relationship between the profile of the meshing blades of the rotating condenser and the angular position of the shaft.

A vacuum pumping system 40 maintains vacuum chamber 8 at a very low pressure so as not to scatter the accelerating beam.

To achieve uniform acceleration in a synchrocyclotron, the frequency and the amplitude of the electric field across the "dee" gap needs to be varied to account for the relativistic mass increase and radial (measured as distance from the center of the spiral trajectory of the charged particles) variation of magnetic field as well as to maintain focus of the beam of particles.

Figure 2:
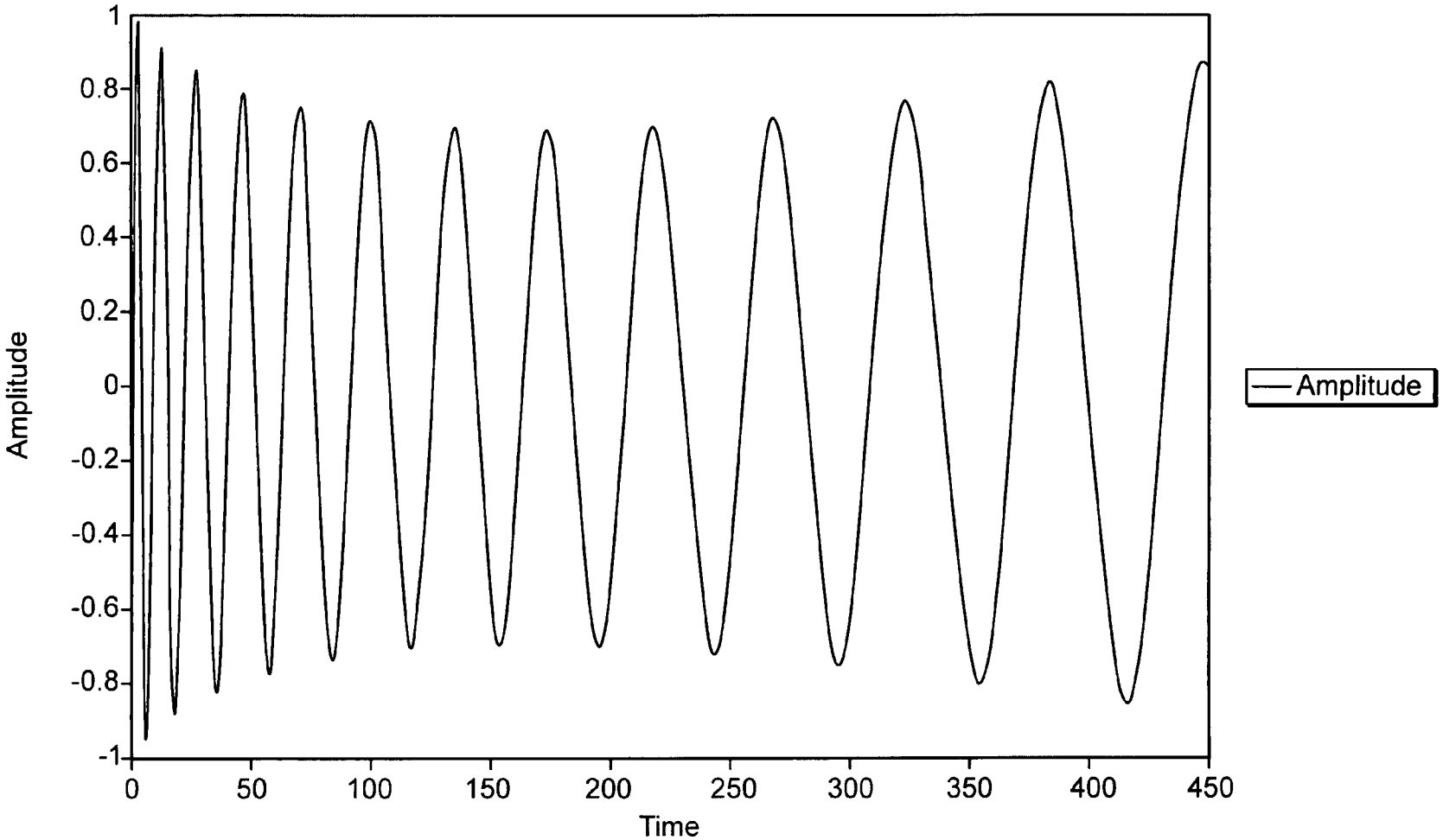
FIG. 2 is an illustration of an idealized waveform that can be used for accelerating charged particles in a synchrocyclotron shown in FIGS. 1A and 1B.

FIG. 2 is an illustration of an idealized waveform that may be required for accelerating charged particles in a synchrocyclotron. It shows only a few cycles of the waveform and does not necessarily represent the ideal frequency and amplitude modulation profiles. FIG. 2 illustrates the time varying amplitude and frequency properties of the waveform used in a given synchrocyclotron. The frequency changes from high to low as the relativistic mass of the particle increases while the particle speed approaches a significant fraction of the speed of light.

The instant invention uses a set of high speed digital to analog converters (DAC) that can generate, from a high speed memory, the required signals on a nanosecond time scale. Referring to FIG. 1A, both a radio frequency (RF) signal that drives the voltage across dee gap 13 and signals that drive the voltage on injector electrode 20 and extractor electrode 22 can be generated from the memory by the DACs. The accelerator signal is a variable frequency and amplitude waveform. The injector and extractor signals can be either of at least three types: continuous; discrete signals, such as pulses, that may operate over one or more periods of the accelerator waveform in synchronism with the accelerator waveform; or discrete signals, such as pulses, that may operate at precisely timed instances during the accelerator waveform frequency sweep in synchronism with the accelerator waveform. (See below with reference to FIGS. 8A-C.)

Figure 3A:
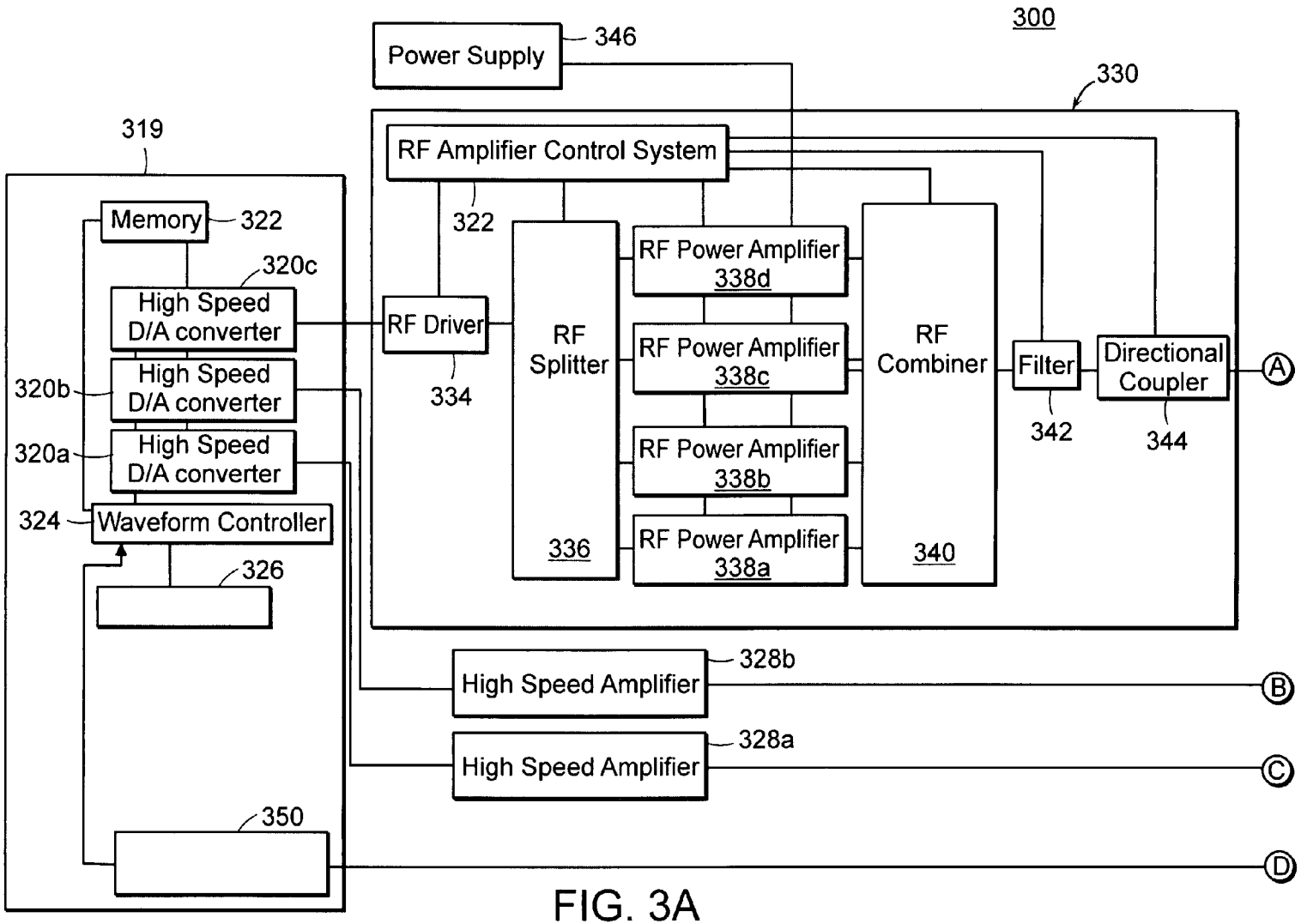
FIG. 3A depicts a portion of a block diagram of a synchrocyclotron of the present invention that includes a waveform generator system.
Figure 3B:
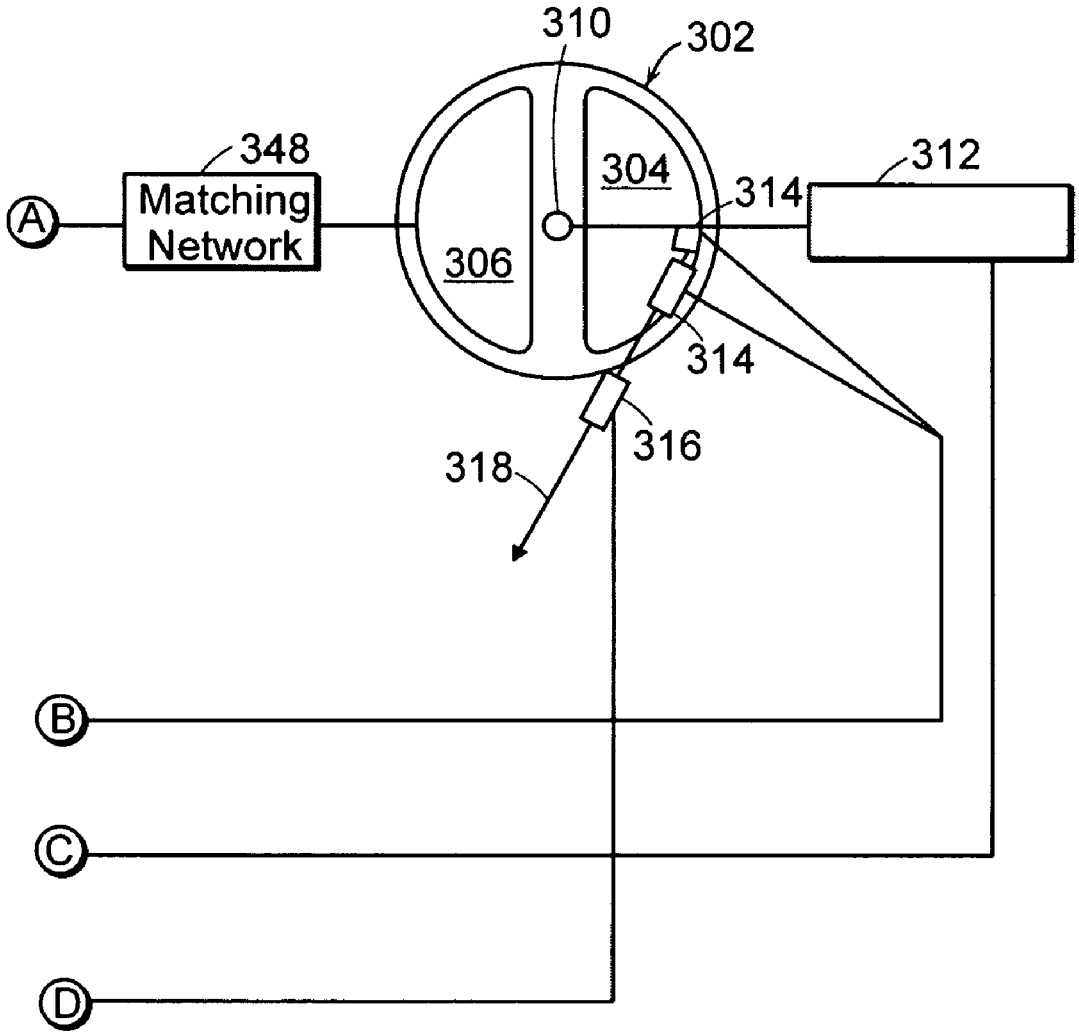
FIG. 3B depicts a portion of a block diagram of a synchrocyclotron of the present invention that includes a waveform generator system.
Figure 4:
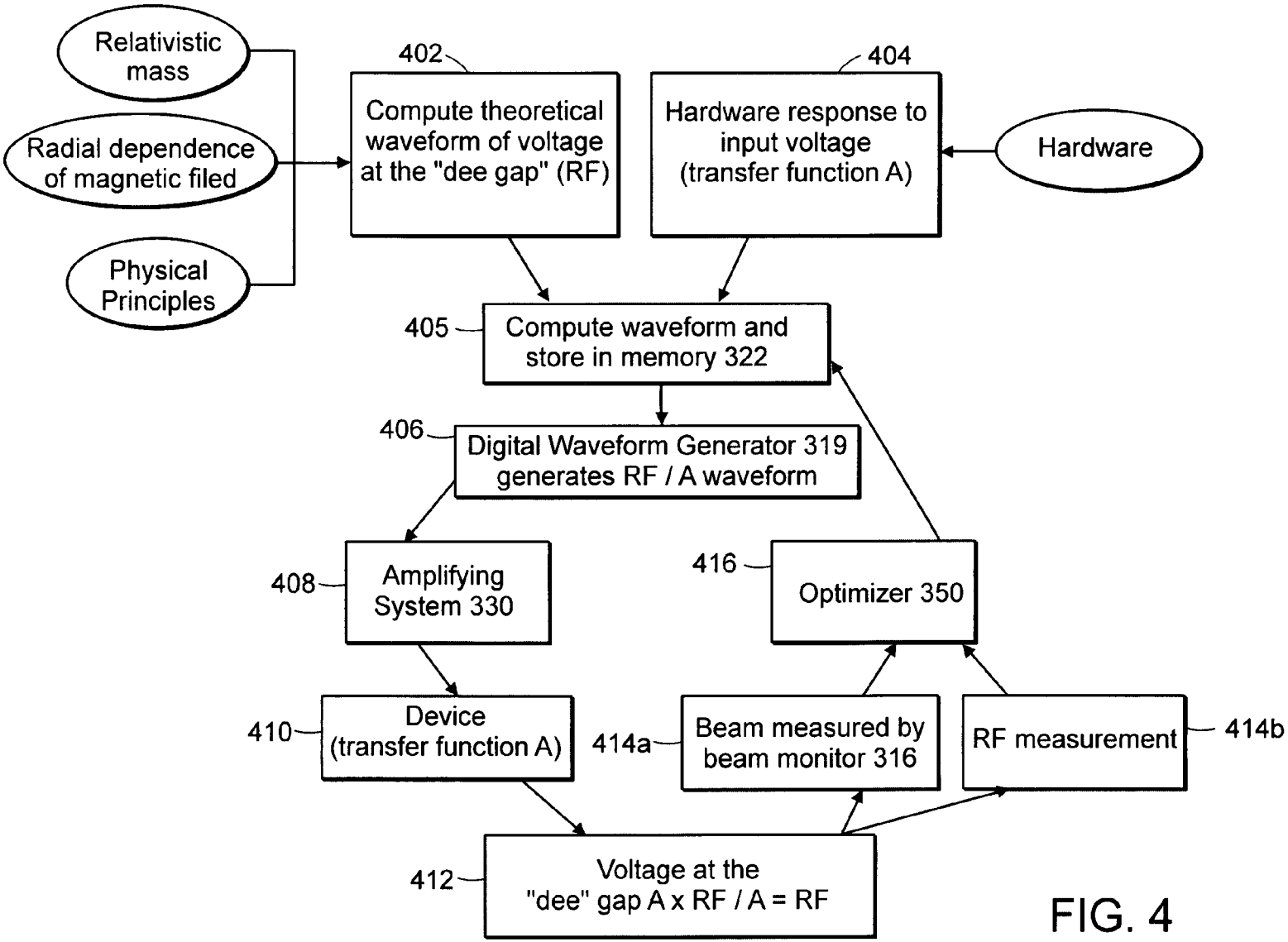
FIG. 4 is a flow chart illustrating the principles of operation of a digital waveform generator and an adaptive feedback system (optimizer) of the present invention.

FIG. 3 depicts a block diagram of a synchrocyclotron of the present invention 300 that includes particle accelerator 302, waveform generator system 319 and amplifying system 330. FIG. 3 also shows an adaptive feedback system that includes optimizer 350. The optional variable condenser 28 and drive subsystem to motor 31 are not shown.

Referring to FIG. 3, particle accelerator 302 is substantially similar to the one depicted in FIGS. 1A and 1B and includes "dummy dee" (grounded dee) 304, "dee" 306 and yoke 308, injection electrode 310, connected to ion source 312, and extraction electrodes 314. Beam monitor 316 monitors the intensity of beam 318.

Synchrocyclotron 300 includes digital waveform generator 319. Digital waveform generator 319 comprises one or more digital-to-analog converters (DACs) 320 that convert digital representations of waveforms stored in memory 322 into analog signals. Controller 324 controls addressing of memory 322 to output the appropriate data and controls DACs 320 to which the data is applied at any point in time. Controller 324 also writes data to memory 322. Interface 326 provides a data link to an outside computer (not shown). Interface 326 can be a fiber optic interface.

The clock signal that controls the timing of the "analog-to-digital" conversion process can be made available as an input to the digital waveform generator. This signal can be used in conjunction with a shaft position encoder (not shown) on the rotating condenser (see FIGS. 1A and 1B) or a resonant condition detector to fine-tune the frequency generated.

FIG. 3 illustrates three DACs 320*a*, 320*b* and 320*c*. In this example, signals from DACs 320*a* and 320*b* are amplified by amplifiers 328*a* and 328*b*, respectively. The amplified signal from DAC 320*a* drives ion source 312 and/or injection electrode 310, while the amplified signal from DAC 320*b* drives extraction electrodes 314.

The signal generated by DAC 320*c* is passed on to amplifying system 330, operated under the control of RF amplifier control system 332. In amplifying system 330, the signal from DAC 320*c* is applied by RF driver 334 to RF splitter 336, which sends the RF signal to be amplified by an RF power amplifier 338. In the example shown in FIG. 3, four power amplifiers, 338*a, b, c* and *d*, are used. Any number of amplifiers 338 can be used depending on the desired extent of amplification. The amplified signal, combined by RF combiner 340 and filtered by filter 342, exits amplifying system 330 though directional coupler 344, which ensures that RF waves do not reflect back into amplifying system 330. The power for operating amplifying system 330 is supplied by power supply 346.

Upon exit from amplifying system 330, the signal from DAC 320*c* is passed on to particle accelerator 302 through matching network 348. Matching network 348 matches impedance of a load (particle accelerator 302) and a source (amplifying system 330). Matching network 348 includes a set of variable reactive elements.

Synchrocyclotron 300 can further include optimizer 350. Using measurement of the intensity of beam 318 by beam monitor 316, optimizer 350, under the control of a programmable processor can adjust the waveforms produced by DACs 320*a, b* and *c* and their timing to optimize the operation of the synchrocyclotron 300 and achieve a optimum acceleration of the charged particles.

The principles of operation of digital waveform generator 319 and adaptive feedback system 350 will now be discussed with reference to FIG. 4.

The initial conditions for the waveforms can be calculated from physical principles that govern the motion of charged particles in magnetic field, from relativistic mechanics that describe the behavior of a charged particle mass as well as from the theoretical description of magnetic field as a function of radius in a vacuum chamber. These calculations are performed at step 402. The theoretical waveform of the voltage at the dee gap, RF(ω, t), where ω is the frequency of the electrical field across the dee gap and t is time, is computed based on the physical principles of a cyclotron, relativistic mechanics of a charged particle motion, and theoretical radial dependency of the magnetic field.

Departures of practice from theory can be measured and the waveform can be corrected as the synchrocyclotron operates under these initial conditions. For example, as will be described below with reference to FIGS. 8A-C, the timing of the ion injector with respect to the accelerating waveform can be varied to maximize the capture of the injected particles into the accelerated bunch of particles.

The timing of the accelerator waveform can be adjusted and optimized, as described below, on a cycle-by-cycle basis to correct for propagation delays present in the physical arrangement of the radio frequency wiring; asymmetry in the placement or manufacture of the dees can be corrected by placing the peak positive voltage closer in time to the subsequent peak negative voltage or vice versa, in effect creating an asymmetric sine wave.

In general, waveform distortion due to characteristics of the hardware can be corrected by pre-distorting the theoretical waveform RF(ω, t) using a device-dependent transfer function A, thus resulting in the desired waveform appearing at the specific point on the acceleration electrode where the protons are in the acceleration cycle. Accordingly, and referring again to FIG. 4, at step 404, a transfer function A(ω, t) is computed based on experimentally measured response of the device to the input voltage.

Figure 6A:
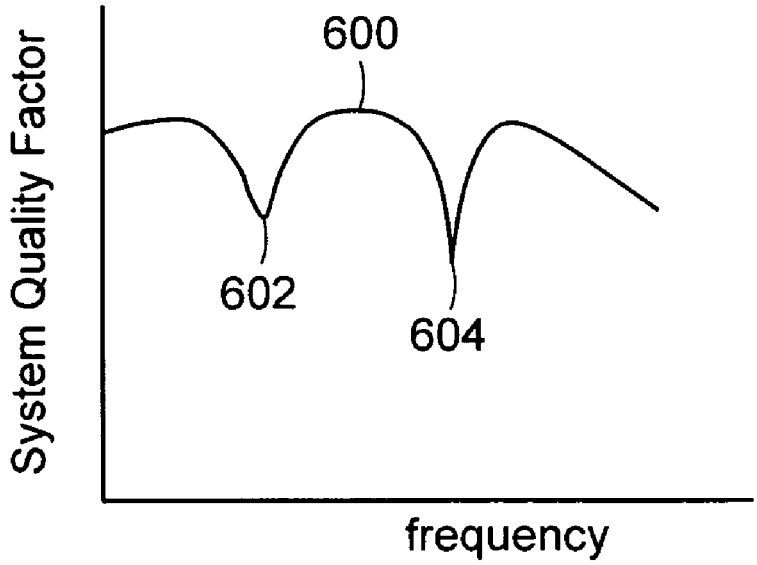
FIG. 6A shows an illustrative frequency response of the resonant system with variations due to parasitic circuit effects.

At step 405, a waveform that corresponds to an expression RF(ω, t)/A(ω,t) is computed and stored in memory 322. At step 406, digital waveform generator 319 generates RF/A waveform from memory. The driving signal RF(ω, t)/A(ω, t) is amplified at step 408, and the amplified signal is propagated through the entire device 300 at step 410 to generate a voltage across the dee gap at step 412. A more detailed description of a representative transfer function A(ω,t) will be given below with reference to FIGS. 6A-C.

After the beam has reached the desired energy, a precisely timed voltage can be applied to an extraction electrode or device to create the desired beam trajectory in order to extract the beam from the accelerator, where it is measured by beam monitor at step 414*a*. RF voltage and frequency is measured by voltage sensors at step 414*b*. The information about beam intensity and RF frequency is relayed back to digital waveform generator 319, which can now adjust the shape of the signal RF(ω, t)/A(ω, t) at step 406.

The entire process can be controlled at step 416 by optimizer 350. Optimizer 350 can execute a semi- or fully automatic algorithm designed to optimize the waveforms and the relative timing of the waveforms. Simulated annealing is an example of a class of optimization algorithms that may be employed. On-line diagnostic instruments can probe the beam at different stages of acceleration to provide feedback for the optimization algorithm. When the optimum conditions have been found, the memory holding the optimized waveforms can be fixed and backed up for continued stable operation for some period of time. This ability to adjust the exact waveform to the properties of the individual accelerator decreases the unit-to-unit variability in operation and can compensate for manufacturing tolerances and variation in the properties of the materials used in the construction of the cyclotron.

The concept of the rotating condenser (such as condenser 28 shown in FIGS. 1A and 1B) can be integrated into this digital control scheme by measuring the voltage and current of the RF waveform in order to detect the peak of the resonant condition. The deviation from the resonant condition can be fed back to the digital waveform generator 319 (see FIG. 3) to adjust the frequency of the stored waveform to maintain the peak resonant condition throughout the accelerating cycle. The amplitude can still be accurately controlled while this method is employed.

The structure of rotating condenser 28 (see FIGS. 1A and 1B) can optionally be integrated with a turbomolecular vacuum pump, such as vacuum pump 40 shown in FIGS. 1A and 1B, that provides vacuum pumping to the accelerator cavity. This integration would result in a highly integrated structure and cost savings. The motor and drive for the turbo pump can be provided with a feedback element such as a rotary encoder to provide fine control over the speed and angular position of rotating blades 30, and the control of the motor drive would be integrated with the waveform generator 319 control circuitry to insure proper synchronization of the accelerating waveform.

Figure 5A:
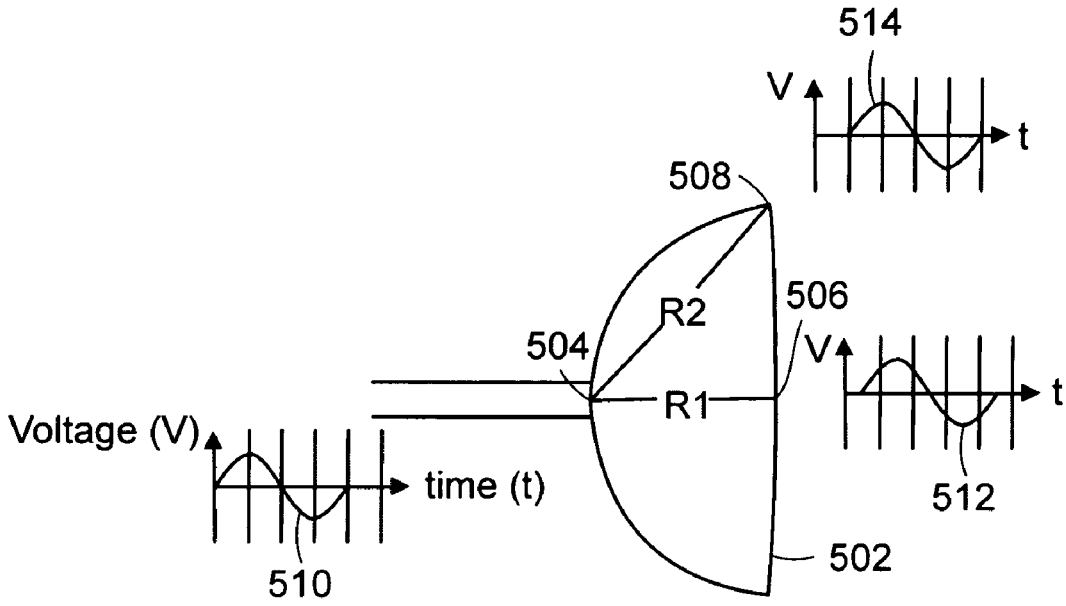
FIG. 5A shows the effect of the finite propagation delay of the signal across different paths in an accelerating electrode ("dee") structure.

As mentioned above, the timing of the waveform of the oscillating voltage input can be adjusted to correct for propagation delays that arise in the device. FIG. 5A illustrate an example of wave propagation errors due to the difference in distances R1 and R2 from the RF input point 504 to points 506 and 508, respectively, on the accelerating surface 502 of accelerating electrode 500. The difference in distances R1 and R2 results in signal propagation delay that affects the particles as they accelerate along a spiral path (not shown) centered at point 506. If the input waveform, represented by curve 510, does not take into account the extra propagation delay caused by the increasing distance, the particles can go out of synchronization with the accelerating waveform. The input waveform 510 at point 504 on the accelerating electrode 500 experiences a variable delay as the particles accelerate outward from the center at point 506. This delay results in input voltage having waveform 512 at point 506, but a differently timed waveform 514 at point 508. Waveform 514 shows a phase shift with respect to waveform 512 and this can affect the acceleration process. As the physical size of the accelerating structure (about 0.6 meters) is a significant fraction of the wavelength of the accelerating frequency (about 2 meters), a significant phase shift is experienced between different parts of the accelerating structure.

Figure 5B:
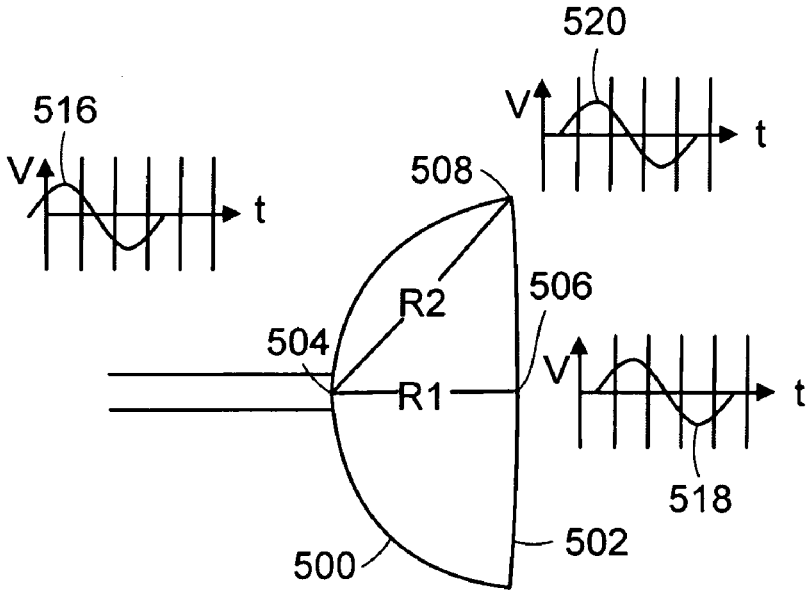
FIG. 5B shows the input waveform timing adjusted to correct for the variation in propagation delay across the "dee" structure.

In FIG. 5B, the input voltage having waveform 516 is pre-adjusted relative to the input voltage described by waveform 510 to have the same magnitude, but opposite sign of time delay. As a result, the phase lag caused by the different path lengths across the accelerating electrode 500 is corrected. The resulting waveforms 518 and 520 are now correctly aligned so as to increase the efficiency of the particle accelerating process. This example illustrates a simple case of propagation delay caused by one easily predictable geometric effect. There may be other waveform timing effects that are generated by the more complex geometry used in the actual accelerator, and these effects, if they can be predicted or measured can be compensated for by using the same principles illustrated in this example.

Figure 6B:
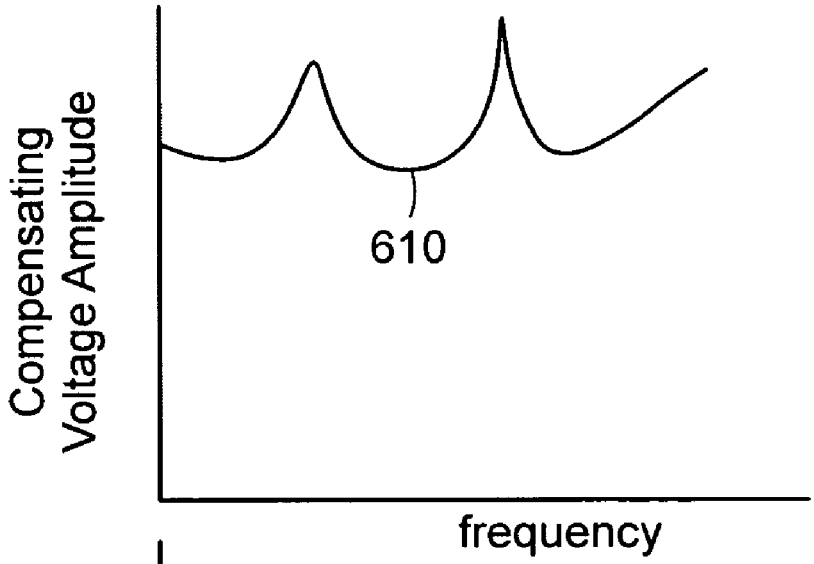
FIG. 6B shows a waveform calculated to correct for the variations in frequency response due to parasitic circuit effects.
Figure 6C:
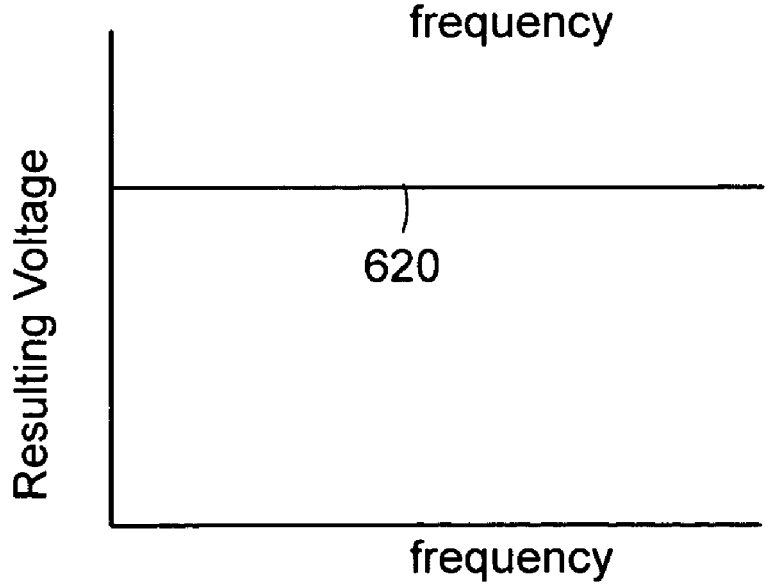
FIG. 6C shows the resulting "flat" frequency response of the system when the waveform shown in FIG. 6B is used as input voltage.

As described above, the digital waveform generator produces an oscillating input voltage of the form RF(ω, t)/A(ω, t), where RF(ω, t) is a desired voltage across the dee gap and A(ω, t) is a transfer function. A representative device-specific transfer function A, is illustrated by curve 600 in FIG. 6A. Curve 600 shows Q-factor as a function of frequency. Curve 600 has two unwanted deviations from an ideal transfer function, namely troughs 602 and 604. These deviation can be caused by effects due to the physical length of components of the resonant circuit, unwanted self-resonant characteristics of the components or other effects. This transfer function can be measured and a compensating input voltage can be calculated and stored in the waveform generator's memory. A representation of this compensating function 610 is shown in FIG. 6B. When the compensated input voltage 610 is applied to device 300, the resulting voltage 620 is uniform with respect to the desired voltage profile calculated to give efficient acceleration.

Another example of the type of effects that can be controlled with the programmable waveform generator is shown in FIG. 7. In some synchrocyclotrons, the electric field strength used for acceleration can be selected to be somewhat reduced as the particles accelerate outward along spiral path 705. This reduction in electric field strength is accomplished by applying accelerating voltage 700, that is kept relatively constant as shown in FIG. 7A, to accelerating electrode 702. Electrode 704 is usually at ground potential. The electric field strength in the gap is the applied voltage divided by the gap length. As shown in FIG. 7B, the distance between accelerating electrodes 702 and 704 is increasing with radius R. The resulting electric field strength as a function or radius R is shown as curve 706 in FIG. 7C.

Figure 7A:
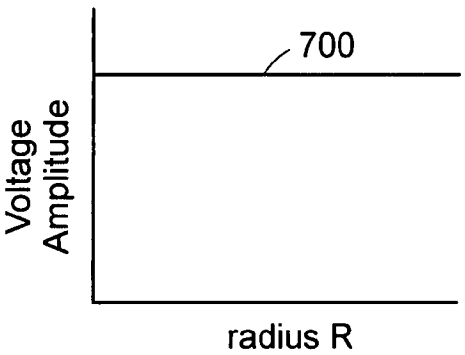
FIG. 7A shows a constant amplitude input voltage applied to the accelerating electrodes shown in FIG. 7B.
Figure 7B:
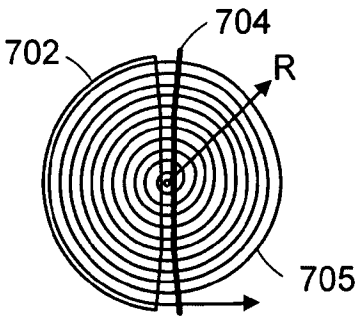
FIG. 7B shows an example of the accelerating electrode geometry wherein the distance between the electrodes is reduced toward the center.
Figure 7C:
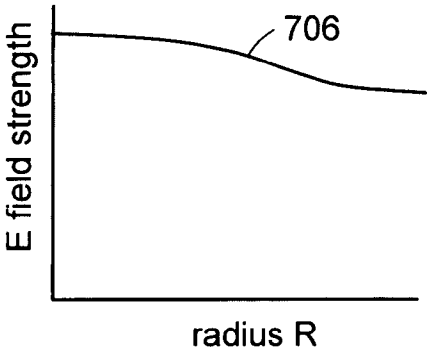
FIG. 7C shows the desired and resultant electric field strength in the electrode gap as a function of radius that achieves a stable and efficient acceleration of charged particles by applying input voltage as shown in FIG. 7A to the electrode geometry shown in FIG. 7B.
Figure 7D:
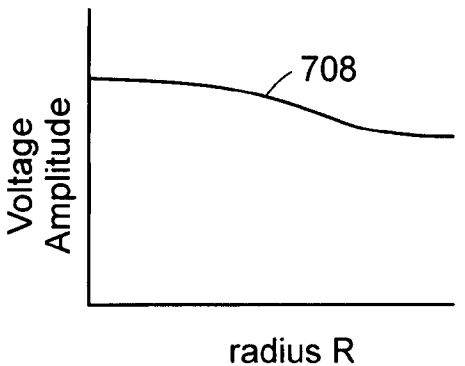
FIG. 7D shows input voltage input as a function of radius that directly corresponds to the electric field strength desired and can be produced using a digital waveform generator.
Figure 7E:
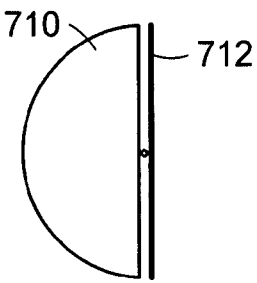
FIG. 7E shows a parallel geometry of the accelerating electrodes which gives a direct proportionality between applied voltage and electric field strength.
Figure 7F:
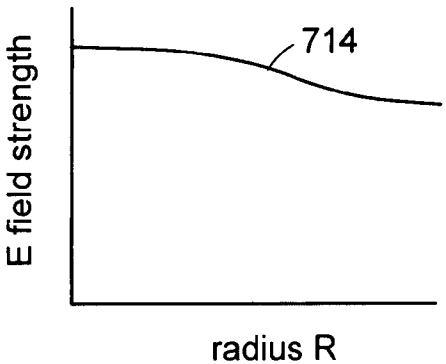
FIG. 7F shows the desired and resultant electric field strength in the electrode gap as a function of radius that achieves a stable and efficient acceleration of charged particles by applying input voltage as shown in FIG. 7D to the electrode geometry shown in FIG. 7E.

With the use of the programmable waveform generator, the amplitude of accelerating voltage 708 can be modulated in the desired fashion, as shown in FIG. 7D. This modulation allows to keep the distance between accelerating electrodes 710 and 712 to remain constant, as shown in FIG. 7E. As a result, the same resulting electric field strength as a function of radius 714, shown in FIG. 7F, is produced as shown in FIG. 7C. While this is a simple example of another type of control over synchrocyclotron system effects, the actual shape of the electrodes and profile of the accelerating voltage versus radius may not follow this simple example.

Figure 8A:
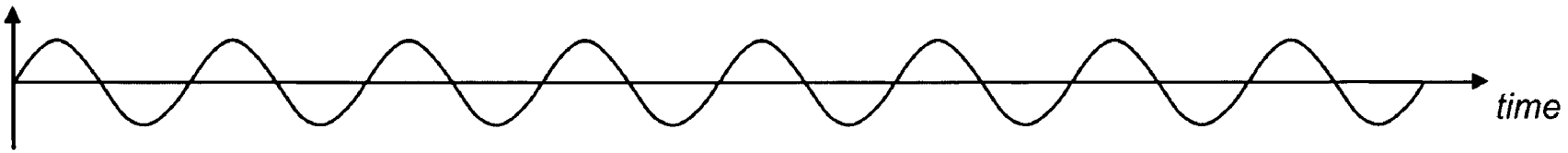
FIG. 8A shows an example of a waveform of the accelerating voltage generated by the programmable waveform generator.
Figure 8B:
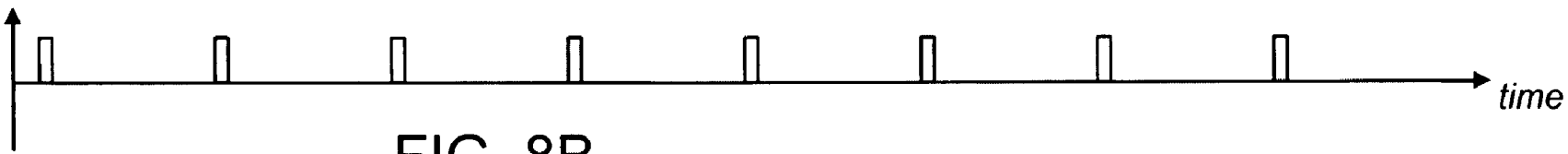
FIG. 8B shows an example of a timed ion injector signal.

As mentioned above, the programmable waveform generator can be used to control the ion injector (ion source) to achieve optimal acceleration of the charged particles by precisely timing particle injections. FIG. 8A shows the RF accelerating waveform generated by the programmable waveform generator. FIG. 8B shows a precisely timed cycle-by-cycle injector signal that can drive the ion source in a precise fashion to inject a small bunch of ions into the accelerator cavity at precisely controlled intervals in order to synchronize with the acceptance phase angle of the accelerating process. The signals are shown in approximately the correct alignment, as the bunches of particles are usually traveling through the accelerator at about a 30 degree lag angle compared to the RF electric field waveform for beam stability. The actual timing of the signals at some external point such as the output of the digital-to-analog converters, may not have this exact relationship as the propagation delays of the two signals is likely to be different. With the programmable waveform generator, the timing of the injection pulses can be continuously varied with respect to the RF waveform in order to optimize the coupling of the injected pulses into the accelerating process. This signal can be enabled or disabled to turn the beam on and off. The signal can also be modulated via pulse dropping techniques to maintain a required average beam current. This beam current regulation is accomplished by choosing a macroscopic time interval that contains some relatively large number of pulses, on the order of 1000, and changing the fraction of pulses that are enabled during this interval.

Figure 8C:
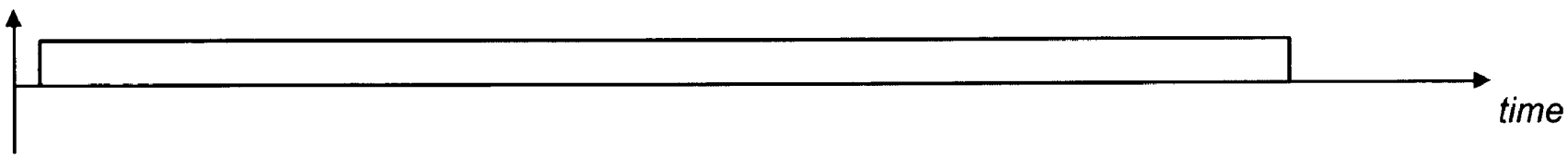
FIG. 8C shows another example of a timed ion injector signal.

FIG. 8C shows a longer injection control pulse that corresponds to a multiple number of RF cycles. This pulse is generated when a bunch of protons are to be accelerated. The periodic acceleration process captures only a limited number of particles that will be accelerated to the final energy and extracted. Controlling the timing of the ion injection can result in lower gas load and consequently better vacuum conditions which reduces vacuum pumping requirements and improves high voltage and beam loss properties during the acceleration cycle. This can be used where the precise timing of the injection shown in FIG. 8B is not required for acceptable coupling of the ion source to the RF waveform phase angle. This approach injects ions for a number of RF cycles which corresponds approximately to the number of "turns" which are accepted by the accelerating process in the synchrocyclotron. This signal is also enabled or disabled to turn the beam on and off or modulate the average beam current.

While this invention has been particularly shown and described with references to preferred embodiments thereof, it will be understood by those skilled in the art that various changes in form and details may be made therein without departing from the scope of the invention encompassed by the appended claims.

What is claimed is:

1. A synchrocyclotron comprising:

a magnetic field generator;

a resonant circuit, comprising:

electrodes, disposed between magnetic poles, having a gap therebetween across the magnetic field; and a variable reactive element in circuit with the electrodes to vary the resonant frequency of the resonant circuit;

a voltage input to the resonant circuit, the voltage input being an oscillating voltage that varies over the time of acceleration of charged particles; and an adaptive feedback system that varies the voltage input to the resonant circuit.

2. The synchrocyclotron as claimed in claim 1 wherein the amplitude of the voltage input is varied.

3. The synchrocyclotron as claimed in claim 1 wherein the frequency of the voltage input is varied.

4. The synchrocyclotron of claim 1 wherein the amplitude and the frequency of the voltage are varied.

5. The synchrocyclotron of claim 1 further including an ion source for injecting charged particles into the synchrocyclotron.

6. The synchrocyclotron of claim 5 further including an extraction electrode, disposed between the magnetic poles to extract a particle beam from the synchrocyclotron.

7. The synchrocyclotron of claim 6 further including a one or more sensors for detecting resonant conditions in the resonant circuit.

8. The synchrocyclotron of claim 7 wherein the frequency of the voltage input is adjusted to maintain the resonant conditions.

9. The synchrocyclotron of claim 8 further including means for controlling the reactance of the variable reactive element and adjusting the resonant frequency of the resonant circuit to maintain the resonant conditions.

10. The synchrocyclotron of claim 9 further including a beam monitor for measuring particle beam, at least one of the voltage input, the ion source and the extraction electrode being controlled to compensate for variations in the particle beam.

11. The synchrocyclotron of claim 10 wherein the beam monitor measures particle beam intensity.

12. The synchrocyclotron of claim 10 wherein the beam monitor measures particle beam timing.

13. The synchrocyclotron of claim 10 wherein the beam monitor measures spatial distribution of the particle beam.

14. The synchrocyclotron as claimed in claim 1 wherein the oscillating voltage input is generated by a programmable digital waveform generator.

15. The synchrocyclotron of claim 10 wherein at least one of the ion source and the extraction electrode is controlled by a programmable waveform generator to compensate for variations in the particle beam.

16. The synchrocyclotron of claim 1 further including a one or more sensors for detecting resonant conditions in the resonant circuit.

17. The synchrocyclotron of claim 1 further including a beam monitor for detecting variations in a particle beam.

18. The synchrocyclotron of claim 1 wherein the frequency of the voltage input is adjusted to maintain the resonant conditions.

19. The synchrocyclotron of claim 1 further including an ion source and an extraction electrode, wherein at least one of the ion source and the extraction electrode is controlled to compensate for variations in a particle beam.

20. The synchrocyclotron of claim 19 further including one or more sensors for detecting resonant conditions in the resonant circuit.

21. The synchrocyclotron of claim 19 further including a beam monitor for detecting variations in a particle beam.

22. The synchrocyclotron of claim 19 wherein the frequency of the voltage input is adjusted to maintain the resonant conditions.

23. A method of producing a particle beam in a synchrocyclotron, comprising:

injecting charged particles into a synchrocyclotron by an ion source;

applying an oscillating voltage input to a resonant circuit comprising accelerating electrodes having a gap therebetween across a magnetic field, to create an oscillating electric field across the gap and accelerating charged particles, the oscillating voltage input being controlled using an adaptive feedback system to vary over the time of acceleration of the charged particles; and extracting the accelerated charged particles by an extraction electrode to form a particle beam.

24. The method of claim 23 wherein the amplitude of the oscillating voltage input is varied.

25. The method of claim 23 wherein the frequency of the oscillating voltage input is varied.

26. The method of claim 23 wherein the amplitude and the frequency of the voltage are varied.

27. The method of claim 23 further including detecting resonant conditions in the resonant circuit.

28. The method of claim 27 wherein the frequency of the voltage input is adjusted to maintain the resonant conditions.

29. The method of claim 28 further including adjusting reactance of a variable reactive element in circuit with the oscillating voltage input and the accelerating electrodes to maintain the resonant conditions in the resonant circuit.

30. The method of claim 29 further including measuring particle beam intensity by a beam monitor; and controlling at least one of the oscillating voltage input, the ion source and the extraction electrode to compensate for variations in the particle beam.

31. The method of claim 30 wherein the beam monitor measures particle beam intensity.

32. The method of claim 30 wherein the beam monitor measures particle beam timing.

33. The method of claim 30 wherein the beam monitor measures spatial distribution of the particle beam.

34. The method of claim 23 wherein the oscillating voltage input is generated by a programmable digital waveform generator.

35. The method of claim 30 wherein at least one of the ion source and the extraction electrode is controlled by a programmable waveform generator to compensate for variations in the particle beam.

36. The method of claim 23 further including detecting resonant conditions in the resonant circuit.

37. The method of claim 23 further including detecting variations in a particle beam.

38. The method of claim 23 further including adjusting the frequency of the voltage input to maintain the resonant conditions.

39. The method of claim 23 further including controlling at least one of the ion source and the extraction electrode to compensate for variations in a particle beam.

40. A synchrocyclotron comprising:

injecting means for injecting charged particles into a synchrocyclotron;

accelerating means for accelerating the charged particles by an oscillating electric field, the oscillating electric field being varied over the time of acceleration of charged particles, the accelerating means including a resonant circuit that comprises accelerating electrodes having a gap therebetween across the magnetic field and an oscillating voltage input driving the oscillating electric field across the gap, the voltage input being varied over the time of acceleration of the charged particles using an adaptive feedback system; and extracting means for extracting the accelerated charged particles to form a particle beam.

41. The synchrocyclotron of claim 40 further including voltage controlling means for varying the oscillating voltage input over the time of acceleration of charged particles.

42. The synchrocyclotron of claim 41 further including monitoring means for monitoring the particle beam.

43. The synchrocyclotron of claim 42 further including resonant frequency controlling means in circuit with the oscillating voltage input and the accelerating electrodes for varying the resonant frequency of the resonant circuit.

44. The synchrocyclotron of claim 43 further including resonance detecting means for detecting resonance conditions in the resonant circuit.

* * * * *